United States Patent [19]

Hess et al.

[11] 4,013,293

[45] Mar. 22, 1977

[54] MAGNETIC GAME APPARATUS

[75] Inventors: Richard E. Hess, Brooklyn Park; Ronald A. Steinbrecher, Fridley; Stephen A. A. Goddard, Minneapolis, all of Minn.

[73] Assignee: H & S Enterprises, Inc., Anoka, Minn.

[22] Filed: Nov. 6, 1975

[21] Appl. No.: 629,656

[52] U.S. Cl. ..... 273/131 AD; 273/136 B; 273/137 AE

[51] Int. Cl.[2] ..... A63F 3/02

[58] Field of Search ..... 273/130, 131, 136, 137

[56] References Cited

UNITED STATES PATENTS

| | | | |
|---|---|---|---|
| 2,687,305 | 8/1954 | Wales | 273/136 B |
| 2,819,904 | 1/1958 | Nelson et al. | 273/130 A |
| 3,761,092 | 9/1973 | Shieff | 273/131 AD |
| 3,765,679 | 10/1973 | O'Connell | 273/131 AD |
| 3,781,013 | 12/1973 | Von Meyer | 273/130 B |

*Primary Examiner*—Delbert B. Lowe

*Attorney, Agent, or Firm*—Merchant, Gould, Smith, Edell Welter & Schmidt

[57] ABSTRACT

A game played on a board like a checker board, in which the men and the playing squares of the board incorporate permanent magnets poled to add randomness to the intended moves of the player.

3 Claims, 5 Drawing Figures

MAGNETIC GAME APPARATUS

BRIEF DESCRIPTION OF THE INVENTION

This invention relates to the field of games, and particularly to a game in which a random factor is added to the well known game of checkers, introducing a component of chance to what has been a game of skill.

SUMMARY OF THE INVENTION

We accomplish this by the use of magnetic inserts in the playing squares of a checker board and in the playing pieces. The magnetic intensities and polarities are chosen so that a playing piece may move independently of the player, when the latter releases the piece after making a move, in a random and unpredictable fashion, which may result for example in the "taking" of one of the player's own pieces.

Various advantages and features of novelty which characterize our invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DESCRIPTION OF THE PREFERRED EMBODIMENT

Figure 1:
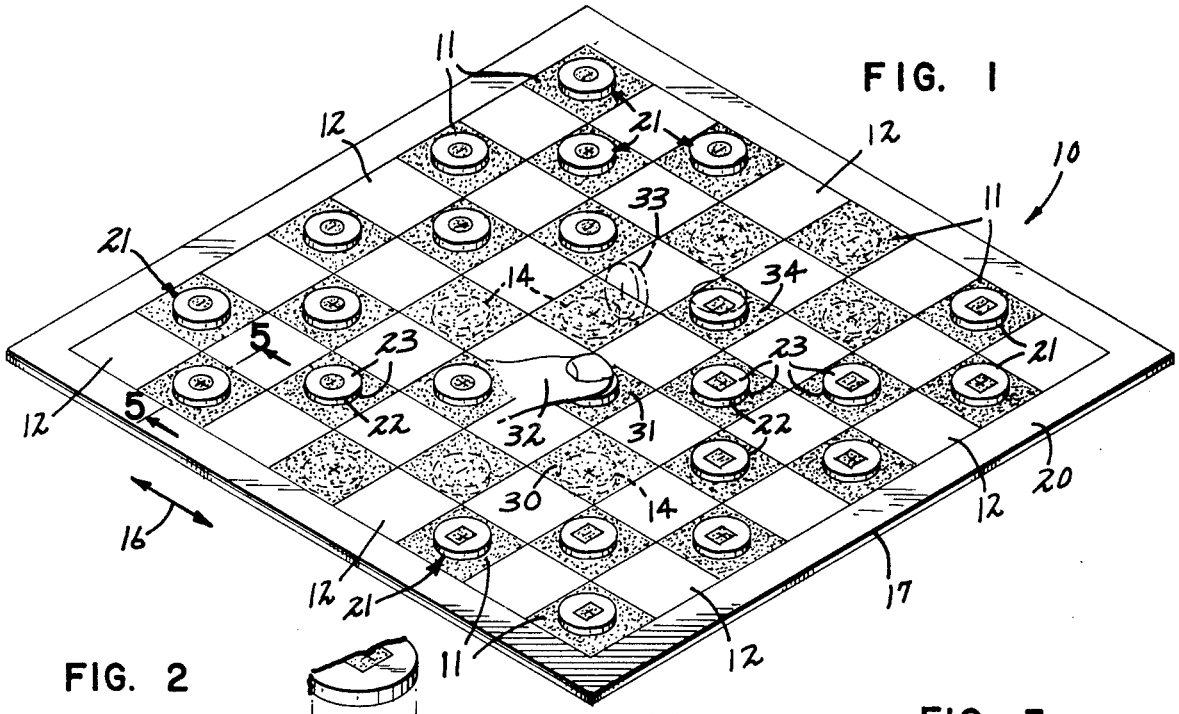
FIG. 1 is a perspective view of the game board and pieces of our invention in the course of play.
Figure 2:
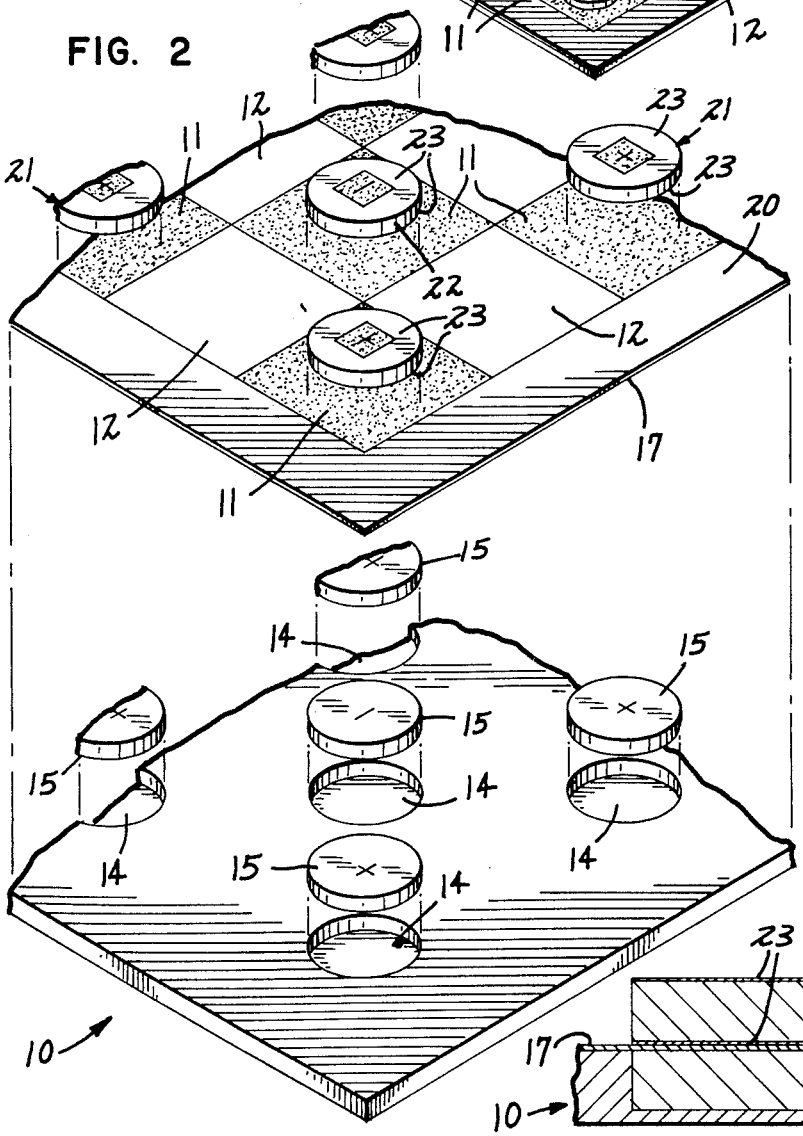
FIG. 2 is an exploded fragmentary view of a portion of FIG. 1 to a larger scale.
Figure 3:
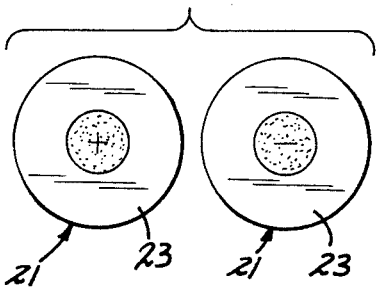
FIGS. 3 and 4 show the distinguishable playing pieces used in our game.
Figure 4:
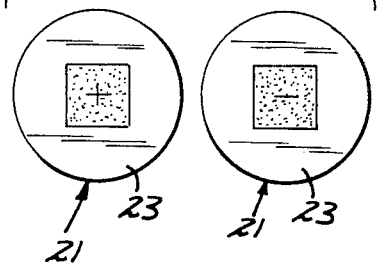
Figure 5:
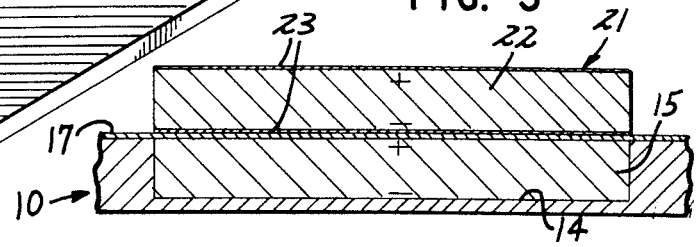
FIG. 5 is a sectional view taken along the line 5—5 of FIG. 1, to a larger scale.

As shown in the drawing, our game includes a game board 10 similar in appearance to a standard checker or chess board, having alternating squares of opposite characteristics, such as contrasting colors, arranged in the well known pattern. By convention, the squares of one color are playing squares 11, and those of the other color are spacing squares 12. For convenience the playing squares 11 are shown as dark colored in FIG. 1.

Board 10 has a plurality of recesses 14 centered under the playing squares, and in each recess is placed a thin, permanently magnetic disc 15. The magnetic axes of the discs are perpendicular to their faces, and the polarities are not random in their arrangement in the board. Defining a row as a set of squares extending orthogonally across the board, the discs in each row are arranged with the same polarity, adjacent rows being of reverse polarity. This is true not only in the playing direction, indicated by the arrow 16, but in the transverse direction as well. Over the top surface of the board and inserted magnets extends a non-magnetic lamina 17 to prevent direct physical contact with magnets 15: the identifying colors of the squares may be provided in this lamina. A border 20 surrounds the field of playing and spacing squares of the board. No magnets underlie spacing squares 12 or any part of border 20.

For use with board 10 are provided a plurality of playing pieces 21 which, like the squares of the board, are of two visually distinguishable characteristics. The pieces incorporate and may comprise flat disc magnets 22 like magnets 15. The pieces are reversible, both sides of each piece having the same distinguishing features. By preference, we apply non-magnetic indicia 23 to both surfaces of each piece, so that it looks the same either side up. Except for their indicia, all the playing pieces are alike. In the drawing, the different indicia are represented by a circle and a square, respectively, but in practice they may be sheets of colored paper, colored pictorial material, or other suitable distinctive indicia.

It will be appreciated that if there is placed, on a playing square having its north pole up, a playing piece having its north pole up, and hence its south pole down, the piece is attracted and held to the playing surface. On the other hand, if a piece is placed on a playing square so that the adjacent polarities are the same, the piece is repelled from the board. The pole strength of the magnets are such that in the case just described the repelling force is greater than the force exerted on the piece by gravity, and if a piece in this position is suddenly released, it is propelled into the air away from the surface of the board. The direction of movement of the piece is essentially random, depending upon the presence or absence of pieces on adjacent squares and on the player's movement in releasing the piece.

An example is shown in FIG. 1. Here a player has lifted his piece from playing square 30 and placed it on playing square 31, where he is holding it with his finger tip. When he releases his finger 32 the piece flies into the air, describing an arcuate path and falling onto the attracting surface of a playing square or a playing piece: in the example, the piece being moved passes through the point 33 and falls on top of a piece in adjacent square 34.

By the rules of this game, the player has "taken" his own man, rather than making it a king, and must remove it, leaving only the playing piece just moved. An opponent's piece is taken in this way, rather than by being jumped as in ordinary checkers. Available moves are one space directly foward along either diagonal for each piece. A player's piece may jump another piece, of his opponent or his own, but he does not remove the piece jumped unless the jumping piece when released flies to land on top of the piece just jumped. Other rules relate to the process of acquiring a king, to the moves of a king, to the procedure in the event of magnetic propulsion of a piece to fall on the border, and to other contingencies particular to the random movements of the pieces.

From the foregoing it will be evident that we have invented a new game which, while based on checkers, differs widely therefrom by magnetically superimposing randomness upon the intended moves of the players.

Numerous characteristics and advantages of our invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. In a game, in combination:

a game board having a thin non-magnetic surface and comprising a uniform array of squares of two visually distinct characteristics arranged in rows and columns, each of alternating characteristics, the squares of one characteristic being played squares and those of the other characteristic being spacing squares;

magnet positioned below the upper surfaces of said playing squares only with their magnetic axes generally perpendicular to the board, the upper poles of magnets in each row of squares being of like polarity and the upper poles of magnets in adjacent rows being of opposite polarity;

and a plurality of thin reversible flat playing pieces including flat magnets arranged with their magnetic axes generally perpendicular to the flat surfaces, so that each piece in a first orientation is magnetically attracted to certain of said playing squares and repelled by others, while in the reverse orientation of the piece the attraction and replusion by the squares is reversed;

the pole strengths of said magnets being such that when like poles in a playing piece and a playing square resting thereon are abutting, the resulting upward repulsion is greater than the force exerted by gravity on the piece.

2. A game board comprising:

a thin non-magnetic upper surface;

a uniform array of squares of two visually distinct characteristics arranged in rows and columns, each of alternating characteristics, the squares of one characteristic being playing squares and those of the other characteristic being spacing squares;

and magnets positioned below the upper surfaces of said playing squares only with their magnetic axes generally perpendicular to the board, the upper poles of magnets in each row of squares being of like polarity, and the upper poles of magnets in adjacent rows being of opposite polarity.

3. In a game, in combination:

A game board having a thin, non-magnetic surface and comprising a uniform array of squares of two visually distinctive characteristics arranged in rows and columns, each of alternating characteristics, the squares of one characteristic being playing squares and those of the other characteristic being spacing squares;

magnets positioned below the upper surfaces of said playing squares only, with their magnetic axes generally perpendicular to the board, the upper poles of magnets in each row of squares being of like polarity and the upper poles of magnets in adjacent rows being of opposite polarity;

and a polarity of reversible flat playing pieces including flat magnets arranged with their magnetic axes generally perpendicular to the flat surfaces, and thin magnetically inert means comprising a pair of identical indicia secured to the surfaces of said pieces, so that each piece in a first orientation is magnetically attracted to certain of said playing squares and repelled by others, while in the reverse orientation of the piece the attraction and repulsion by the squares is reversed;

the pole strengths of said magnets being such that when like poles in a playing square and playing piece resting thereon are abutting, the resulting upward repulsion is greater than the force exerted by gravity on the piece.

* * * * *

UNITED STATES PATENT AND TRADEMARK OFFICE

CERTIFICATE OF CORRECTION

PATENT NO. : 4,013,293
DATED : March 22, 1977
INVENTOR(S) : Richard E. Hess, et al.

It is certified that error appears in the above-identified patent and that said Letters Patent are hereby corrected as shown below:

Column 2, line 21, strength should be "strengths".

Column 3, line 13, magnet should be "magnets".

Column 4, line 23, polarity should be "plurality".

Signed and Sealed this

Seventh Day of June 1977

[SEAL]

*Attest:*

RUTH C. MASON
*Attesting Officer*

C. MARSHALL DANN
*Commissioner of Patents and Trademarks*